United States Patent [19]

Cellone et al.

[11] Patent Number: 5,077,189

[45] Date of Patent: Dec. 31, 1991

[54] LIGHT-SENSITIVE SILVER HALIDE PHOTOGRAPHIC MATERIAL

[75] Inventors: Luigi Cellone, Albissola Marina; Mario Mariotti, Carcare, both of Italy

[73] Assignee: Minnesota Mining and Manufacturing Company, St. Paul, Minn.

[21] Appl. No.: 601,262

[22] Filed: Oct. 22, 1990

[30] Foreign Application Priority Data

Oct. 31, 1989 [IT] Italy ..... 22219 A/89

[51] Int. Cl.[5] ..... G03C 1/08; G03C 1/34

[52] U.S. Cl. ..... 430/567; 430/569; 430/599; 430/600; 430/603; 430/607

[58] Field of Search ..... 430/566, 567, 599, 600, 430/603, 607, 569

[56] References Cited

U.S. PATENT DOCUMENTS

| | | | |
|---|---|---|---|
| 3,929,486 | 12/1975 | Habu et al. | 430/607 |
| 4,433,048 | 2/1984 | Solberg et al. | 430/570 |
| 4,434,226 | 2/1984 | Wilgus et al. | 430/569 |
| 4,999,282 | 3/1991 | Sato et al. | 430/569 |

*Primary Examiner*—Hoa Van Le

*Attorney, Agent, or Firm*—Gary L. Griswold; Walter N. Kirn; Mark A. Litman

[57] ABSTRACT

Light-sensitive silver halide photographic materials are disclosed comprising a support and silver halide emulsion layer or layers, wherein at least one of said silver halide emulsion layers contains tabular silver halide grains having an average diameter:thickness ratio of at least 3:1 and at least one resorcinol.

The light-sensitive materials can be advantageously used in high temperature processing without causing serious fog problems.

8 Claims, No Drawings

LIGHT-SENSITIVE SILVER HALIDE PHOTOGRAPHIC MATERIAL

FIELD OF THE INVENTION

This invention relates to a light-sensitive silver halide photographic material and, more particularly, to a light-sensitive silver halide photographic material comprising tabular silver halide grains.

BACKGROUND OF THE INVENTION

Tabular silver halide grains are crystal possessing two major faces that are substantially parallel in which the average diameter of said faces is at least three times (and often more times) the distance separating them.

Silver halide photographic emulsions containing a high proportion of tabular grains have advantages of good developability, improved covering power and increased useful adsorption of sensitizing dye per weight of silver due to their high surface area-to-volume ratio. The use of such emulsions in photographic materials is disclosed in U.S. Pat. Nos. 4,425,425, 4,433,048, 4,435,499, 4,439,520, and other related patents.

However, photographic materials containing tabular silver halide grains also have certain disadvantages. One of these is that they tend to easily fog under high temperature accelerated processing. Therefore, tabular silver halide grains are not satisfactory for use in photographic emulsions required to have high sensitivity and low fog.

It is known to incorporate various additives, such as stabilizers and antifoggants, in ordinary light-sensitive silver halide photographic materials for minimizing the rise of fog in dependence of the development processing conditions. For example, nitrobenzimidazoles, mercaptothiazoles, benzotriazoles, nitrobenzotriazoles, mercaptotetrazoles, etc., are described as such additives in E.J. Birr, Stabilization of Photographic Silver Halide Emulsions, Focal Press, and in U.S. Pat. Nos. 3,954,474, 3,982,974, etc. However, while these additives can depress an increase of fog in a light-sensitive silver halide photographic material containing tabular grains during high temperature processing to some extent, a remarkable decrease in sensitivity cannot be prevented.

For example, it is known to use light-sensitive silver halide photographic materials in high-temperature development processing using automatic developing machines. In order to enhance the physical strength of the photographic materials during the development at high temperature and in automatic developing machines and prevent them from becoming physically fragile it is known to conduct the processing with an aldehyde hardener in the developing solution. However, a developing process with a developing solution containing an aldehyde, particularly an aliphatic dihaldehyde, concurrently causes an increase of fog, particularly as the temperature of the developing solution increases. The fog can be depressed to some extent by using strong antifogging agents such as benzotriazole and 1-phenyl-5-mercaptotetrazole in the developing solutions (as described in L.F. Mason, Photographic Processing Chemistry, Focal Press). However, these antifogging agents, when used to develop light-sensitive silver halide photographic materials containing tabular silver halide grains, concurrently depress development and reduce emulsion sensitivity.

Aromatic hydroxy compounds such as α-naphthol, pyrocatechol, resorcinol, methoxyphenol or naphthol-sulphonic acid have been disclosed for preventing latent image regression in DE 1,107,508. 1,3-Dihydroxybenzene carboxylic compounds have been disclosed in U.S. Pat. No. 3,380,828 to prevent stain formation in unhardened silver halide emulsions comprising a developing agent and a hardener precursor for use in rapid processing systems. 2,5- and 3,5-dihydroxybenzene carboxylic acids have been described in DE 1,171,266 to decrease fog in fresh and stored silver halide emulsions. No reference is made in these patents to silver halide emulsions comprising tabular silver halide grains.

Reducing agents, such as chromans, tocopherols, hydrazines, p-phenylenediamines, aldehydes, aminophenols, phenidones, sulfites, $H_2$ gas, sulphinic acids, di- or trihydroxybenzenes, endiols, oximes and reducing sugars, are disclosed in DE 3,615,336 as added to silver halide emulsions containing tabular grains produced in the presence of an oxidant compound, such as H202, a peroxy-acid salt and $O_3$. The reducing agent is deactivated or reduced during or after the chemical ripening.

SUMMARY OF THE INVENTION

There is provided by the present invention a lightsensitive silver halide photographic material comprising a support and silver halide emulsion layer or layers, wherein at least one of said silver halide emulsion layers contains tabular silver halide grains having an average diameter:thickness ratio of at least 3:1 and at least one m-dihydroxybenzene compound.

The light-sensitive material of this invention can be advantageously used in high temperature processing without causing serious fog problems.

DETAILED DESCRIPTION OF THE INVENTION

The present invention relates to a light-sensitive silver halide photographic material comprising a support and silver halide emulsion layer or layers, wherein at least one of said silver halide emulsion layers contains tabular silver halide grains having an average diameter:-thickness ratio of at least 3:1 and at least one m-dihydroxybenzene compound.

In particular, the present invention relates to a light-sensitive silver halide photographic material comprising a support and silver halide emulsion layer or layers free of latent image, wherein at least one of said silver halide emulsion layers contains tabular silver halide grains having an average diameter:thickness ratio of at least 3:1 and a fog suppressing amount of at least one n-dihydroxybenzene compound.

m-Dihydroxybenzene compounds for use in the present invention have a formula selected from the group consisting of:

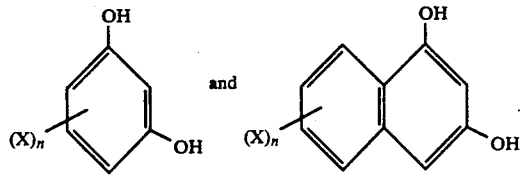

wherein X is selected from the group consisting of a sulfo radical having the formula —$SO_3H$, a water-soluble salt of said sulfo radical, a carboxy radical having the formula —COOH, a water-soluble salt of said carboxy radical and a hydrogen atom, and n represents 1 or 2. Water-soluble salts of the m-dihydroxybenzene compounds above include alkali metal salts (e.g., sodium and potassium) and ammonium salts. Illustrative m-dihydroxybenzene compounds that are used in the silver halide emulsion according to this invention include: m-dihydroxybenzene (resorcinol), 3,5-dihydroxybenzene carboxylic acid, 3,5-dihydoxybenzene sulfonic acid, 3,5-dihydoxybenzene sulfonic acid sodium salt, 1,3-dihydroxy-6,7-disulfonaphthalene potassium salt, and the like.

The m-didydroxybenzene compounds may be incorporated in the silver halide emulsion layer or in a layer of the light-sensitive silver halide photographic material having a water-permeable relationship with the silver halide emulsion layer. Preferably, the m-didydroxybenzene compounds are incorporated in the silver halide emulsion layer.

The amount of the subject m-dihydroxybenzene compounds that is used in the silver halide emulsion of the photographic material of this invention can be widely varied. Generally, about 1 to 300 millimoles of the m-dihydroxybenzene compound per mole of silver halide in the silver halide emulsion layer containing said tabular silver halide grains are utilized, although the preferred concentration range is about 5 to 100 millimoles of the m-dihydroxybenzene compound per mole of silver halide in the silver halide emulsion layer containing said tabular silver halide grains.

The m-dihydroxybenzene compounds of this invention can be added to the silver halide emulsion layer containing said tabular silver halide grains utilizing any of the well-known techniques in emulsion making. For example, they can be dissolved in a suitable solvent and added to the silver halide emulsion, or they can be added to the emulsion in the form of a dispersion similar to the technique utilized to incorporate certain types of color-forming compounds (couplers) in photographic emulsions. Techniques of this type are described in U.S. Pat. Nos. 2,322,027 and 2,801,171. The solvent should be selected so that it has no harmful effect upon the emulsion in accordance with usual practice, and generally, solvents or diluents that are miscible with water are preferred.

The tabular silver halide grains contained in the silver halide emulsion layers of this invention have an average diameter:thickness ratio (often referred to in the art as average aspect ratio) of at least 3:1, preferably 5:1 to 30:1 and more preferably 7:1 to 15:1. Average diameters of the tabular silver halide grains suitable for use in this invention range from about 0.3 to about 5 micrometeres, preferably 0.5 to 3 micrometers, more preferably 0.8 to 1.5 micrometers. The tabular silver halide grains suitable for use in this invention have a thickness of less than 0.4 micrometers, preferably less than 0.3 micrometers and more preferably less than 0.2 micrometers.

The grain characteristics described above of the tabular silver halide grains can be readily ascertained by procedures well known to those skilled in the art. The term "diameter" is defined as the diameter of a circle having an area equal to the projected area of the grain. The term "thickness" means the distance between the two substantially parallel main planes constituting the tabular silver halide grains. From the measure of diameter and thickness of each grain the diameter:thickness of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice it is simpler to obtain an average diameter and an average thickness of the tabular grains and to calculate the average diameter:thickness ratio as the ratio of these two averages. Whatever the used method may be, the average diameter:thickness ratios obtained do not significantly differ.

In the silver halide emulsion layer containing tabular silver halide grains of the invention, at least 40% of the silver halide grains are tabular grains having an average diameter:thickness ratio of at least 3:1. More preferably, at least 70% of the silver halide grains are tabular grains having an average diameter:thickness ratio of not less than 3:1. Each of the above proportions, "40%" and "70%" means the proportion of the total projected area of the tabular grains having a diameter:thickness ratio of at least 3:1 to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halide include silver chloride, silver bromide, silver iodide, silver chloroiodide, silver bromoiodide, silver chlorobromoiodide and the like. However, silver bromide and silver bromoiodide are preferrd silver halide compositions for tabular silver halide grains with silver bromoiodide containing 0 to 10 mol% silver iodide. The halogen composition of individual grains may be homogeneous or heterogeneous.

Silver halide emulsions containing tabular silver halide grains can be prepared with various processes known in the conventional technology for the preparation of photographic materials. Silver halide emulsions can prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121-125, in Gutoff, "Nucleation and Growth Rates During the Precipitation of Silver Halide Photographic Emulsions", Photographic Science and Engineering, Vol. 14, No. 4 (1970), pp. 248-257,in Berry et al., "Effects of Environment on the Growth of Silver Bromide Microcrystals", Vol.5, No.6 (1961), pp. 332-336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions containing tabular silver halide grains, a wide variety of hydrophilic dispersing agents for the silver halides can be employed. Gelatin is preferrred, although other colloidal materials such as gelatin derivatives, colloidal albumin, cellulose derivatives or synthetic hydrophilic polymers can be used as known in the art.

The silver halide emulsions containing tabular silver halide grains used in the present invention can be chemically and optically sensitized with methods well known in the art. The silver halide emulsion layer containing the tabular silver halide grains of this invention can contain other constituents generally used in such products, such as binders, hardeners, surfactants, speed-incresing agents, plasticizers, optical sensitizers, dyes, ultraviolet absorbers, etc., and reference can be made to, for example, Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The light-sensitive silver halide photographic material of this invention can be prepared by coating the light-sensitive silver halide emulsion layer or layers and other auxiliary layers on a support. There is no limitation with respect to the support. Examples of materials suitable for the preparation of the support include glass, paper, polyethylene-coated paper, metals, cellulose nitrate, cellulose acetate, polystyrene, polyethylene terephthalate, polyethylene, polypropylene and other well known supports.

The light-sensitive silver halide photographic materials of this invention specifically are applicable to light-sensitive photographic color materials such as color negative films, color reversal films, color papers, etc., as well as black-and-white light-sensitive photographic materials such as X-ray light-sensitve materials, lithographic light-sensitive materials, black-and-white photographic printing papers, black-and-white negative films, etc.

Preferred light-sensitive silver halide photographic materials according to this invention are X-ray light-sensitive materials comprising a silver halide emulsion layer or layers coated on one surface, preferably on both surfaces of a support, preferably a polyethylene terephthalate support, wherein at least one of said silver halide emulsion layers contains tabular silver halide grains having an average diameter:thickness ratio of at least 3:1 and at least one m-dihydroxybenzene compound. Preferably, the silver halide emulsions are coated on the support at a total silver coverage comprised in the range of 3 to 6 grams per square meter. Usually, the X-ray light-sensitive materials are associated with intensifying screens so as to be exposed to radiation emitted by said screens. The screens are made of relatively thick phosphor layers which transform the X-rays into light radiation (e.g., visible light). The screens absorb a portion of X-rays much larger than the light-sensitive material and are used to reduce the X-ray dose necessary to obtain a useful image. According to their chemical composition, the phosphors can emit radiation in the blue, green or red region of the visible spectrum and the silver halide emulsions are sensitized to the wavelength region of the light emitted by the screens. Sensitization is performed by using spectral sensitizing dyes adsorbed on the surface of the silver halide grains as known in the art.

More preferred light-sensitive silver halide photographic materials according to this invention are X-ray light-sensitive materials which employ one or more high diameter:thickness ratio tabular grain silver halide emulsions or intermediate diameter:thickness ratio tabular grain silver halide emulsions, as disclosed in U.S. Pat. Nos. 4,425,425 and 4,425,426 and in EP Pat. Appln. 84,637.

The exposed light-sensitive materials of this invention can be processed by any of the conventional processing techniques. The processing can be a black-and-white photographic processing for forming a silver image or a color photographic processing for forming a dye image depending upon the purpose. Such processing techniques are illustrated for example in Research Disclosure, 17643, December 1978. Roller transport processing in an automatic processor is particularly preferred, as illustrated in U.S. Pat. Nos. 3,025,779, 3,515,556, 3,545,971 and 3,647,459 and in UK Pat. No. 1,269,268. Hardening development can be undertaken, as illustrated in U.S. Pat. No. 3,232,761.

The present invention remarkably reduces fog formation, whithout concurrent reduction in sensitivity, by adding a m-dihydroxybenzene compound to a silver halide emulsion layer containing tabular silver halide grains. This invention, in particular, is effective for high temperature, accelerated processing with a roller transport automatic processor in a developing solution containing an aldehyde type hardener.

The invention can be better appreciated by reference t the following illustrative examples.

EXAMPLE 1

A tabular grain silver bromide emulsion (having an average diameter: thickness ratio of 8:1) was optically sensitized to green light with a cyanine dye and chemically sensitized with sodium thiosulfate and gold thiocyanate complex. The emulsion, containing a wetting agent and 5-methyl-7-hydroxytriazaindolizine stabilizer, was divided into five portions. The five portions were added with the compounds indicated in Table 1 and with a bis-vinylsulfonylhethylether hardener. Each portion was coated on a side of a blue polyester film support at a silver coverage of 5 g/m$^2$. An inert gelatin protective supercoat containing 1.5 g/m$^2$ of gelatin and dimethylolurea and resorcinaldehyde hardeners was applied on each coating (films 1A to 5A).

A cubic grain silver bromoiodide emulsion (having 2.3% mol iodide and an average diameter of 0.7 micrometers) was optically and chemically sensitized as above. The emulsion, containing a wetting agent and 5-methyl-7-hydroxy-triazaindolizine stabilizer, was divided in two portions. The two portions were added with the compounds indicated in Table 1 and with dimethylolurea and resorcinaldehyde hardeners. Each portion Was coated on a side of a blue polyester film support at a silver coverage of 5 g/m$^2$. An inert gelatin protective supercoat containing 1.5 g/m$^2$ of gelatin and dimethylolurea and resorcinaldehyde hardeners was applied on each coating (films 6A and 7A).

TABLE 1

| Film | Resorcinol g/mol Ag | 5-nitroindazole mg/mol Ag | Polyvinyloxazolidone mg/mol Ag |
|---|---|---|---|
| 1A | 0 | 278 | 249 |
| 2A | 0 | 0 | 0 |
| 3A | 6.2 | 0 | 0 |
| 4A | 12.3 | 0 | 0 |
| 5A | 12.3 | 278 | 0 |
| 6A | 0 | 0 | 249 |
| 7A | 6.2 | 0 | 0 |

Samples of each film were aged for different times and temperatures: 15 hours at 50° C., 5 days at 50° C.

and 4 hours at 70° C. Aged samples of each film were exposed for 0.1 seconds to white light through band green and blue filters and processed in a 3M Trimatic TM XP 507 roller transport processor. Processing consisted of 3M XAD/2 Developer for 27 seconds at 35° C., followed by fixing in 3M XAF/2 Fixer for 27 seconds at 30° C., washing with tap water for 22 seconds at 35° C. and drying for 22 seconds at 35° C. The sensitometric results are tabulated in the following Table 2.

TABLE 2

| | 4 h 70° C. | 15 h 50° C. | | | 5 days 50° C. | | |
|---|---|---|---|---|---|---|---|
| Film | Dmin | Dmin | Speed1 | Speed2 | Dmin | Speed1 | Speed2 |
| 1A | 1.26 | 0.21 | 100 | 100 | 0.50 | 182 | 141 |
| 2A | 1.77 | 0.21 | 100 | 100 | 0.55 | 138 | 132 |
| 3A | 0.28 | 0.21 | 123 | 107 | 0.22 | 144 | 138 |
| 4A | 0.27 | 0.22 | 123 | 103 | 0.21 | 138 | 132 |
| 5A | 0.26 | 0.21 | 100 | 112 | 0.21 | 126 | 115 |
| 6A | 0.22 | 0.17 | 100 | 100 | 0.18 | 110 | 107 |
| 7A | 0.23 | 0.18 | 100 | 110 | 0.21 | 110 | 129 |

(speed1 is the relative sensitivity for the blue light exposure measured at 0.25 above Dmin and speed2 is the relative sensitivity for the green light exposure measured at 0.25 above Dmin).

EXAMPLE 2

A tabular grain silver bromide emulsion (having an average diameter: thickness ratio of 8:1) was optically sensitized to green light with a cyanine dye and chemically sensitized with sodium thiosulfate and gold thiocyanate complex. The emulsion, containing a wetting agent and 5-methyl-7-hydroxytriazaindolizine stabilizer, was divided in five portions. The five portions were added with the compounds indicated in Table 3 and with a bis-vinylsulfonylhethylether hardener. Each portion was coated on a side of a blue polyester film support at a silver coverage of 5 g/m$^2$. An inert gelatin protective supercoat containing 1.5 g/m$^2$ of gelatin and dimethylolurea and resorcinaldehyde hardeners was applied on each coating (films 1B to 5B).

A cubic grain silver bromoiodide emulsion (having 2.3% mol iodide and an average diameter of 0.7 micrometers) was optically and chemically sensitized as above. The emulsion, containing a wetting agent and 5-methyl-7-hydroxy-triazaindolizine stabilizer, was added with the compounds indicated in Table 3 and with dimethylolurea and resorcinaldehyde hardeners. The emulsion was coated on a side of a blue polyester film support at a silver coverage of 5 g/m$^2$. An inert gelatin protective supercoat containing 1.5 g/m$^2$ of gelatin and dimethylolurea and resorcinaldehyde hardeners was applied on the coating (film 6B).

TABLE 3

| | Film | | | | | |
|---|---|---|---|---|---|---|
| | 1B | 2B | 3B | 4B | 5B | 6B |
| Resorcinol g/mol Ag | 3.1 | 0 | 0 | 0 | 0 | 0 |
| Pyrocathecol disulfonate g/mol Ag | 0 | 9.25 | 0 | 0 | 0 | 0 |
| Pyrocathecol g/mol Ag | 0 | 0 | 0 | 3.1 | 0 | 0 |
| Hydroquinone g/mol Ag | 0 | 0 | 0 | 0 | 3.1 | 0 |
| Polyvinyloxazolidone mg/mol Ag | 0 | 0 | 0 | 0 | 0 | 249 |

Samples of each film were aged for different times and temperatures: 15 hours at 50° C. and 5 days at 50° C. Aged samples of each film were exposed for 0.1 seconds to white light through a band green filter and processed in a 3M Trimatic TM XP 507 roller transport processor. Processing consisted of 3M XAD/2 Developer for 27 seconds at 35° C., followed by fixing in 3M HAF/2 Fixer for 27 seconds at 30° C., washing with tap water for 22 seconds at 35° C. and drying for 22 seconds at 35° C.

The sensitometric results are tabulated in the following Table 4.

TABLE 4

| | 15 h 50° C. | | | 5 days 50° C. | | |
|---|---|---|---|---|---|---|
| Film | Dmin | Speed1 | Speed2 | Dmin | Speed1 | Speed2 |
| 1B | 0.18 | 2.78 | 2.41 | 0.19 | 2.82 | 2.44 |
| 2B | 0.18 | 2.71 | 2.36 | 0.26 | 2.73 | 2.31 |
| 3B | 0.18 | 2,78 | 2.40 | 0:25 | 2.74 | 2.37 |
| 4B | 0.18 | 2.68 | 2.31 | 0.20 | 2.71 | 2.28 |
| 5B | 0.20 | 2.71 | 2.35 | 0.20 | 2.70 | 2.32 |
| 6B | 0.21 | 2.73 | 2.41 | 0.18 | 2.80 | 2.44 |

(speed1 is the absolute sensitivity for the green light exposure measured at 0.25 above Dmin and speed2 is the absolute sensitivity for the green light exposure measured at 1.0 above Dmin).

EXAMPLE 3

A tabular grain silver bromide emulsion (having an average diameter: thickness ratio of 8:1) was prepared. The emulsion was optically sensitized to green light with 0.750 g/mol Ag of a cyanine dye, added with KI in an amount of 60 mg/mol Ag and chemically sensitized with sodium thiosulfate and gold thiocyanate complex. The emulsion, containing a wetting agent and 5-methyl-7-hydroxytriazaindolizine stabilizer, was added with 3.1 g/mol Ag of resorcinol and with a bis-vinylsulfonylhethylether hardener. The emulsion was coated on both sides of a blue polyester film support at a silver coverage of 1.9 g/m$^2$ Ag and 1.4 g/m$^2$ gelatin per side. An inert gelatin protective L- supercoat containing 1.5 g/m$^2$ of gelatin and dimethylolurea and resorcinaldehyde hardeners was applied on each silver halide emulsion layer (film 1C).

A second film (film 2C) was prepared similar to film 1C but not containing resorcinol.

Samples of each film were aged for different times and temperatures: 15 hours at 50° C. and 5 days at 50° C. Aged samples of each film were interposed between two green emitting 3M Trimax TM T8 intensifying screens, then exposed for 0.15 seconds to X-rays of 300 mA and 80 kV. After exposure, the films were processed in a 3M Trimatic TM XP 507 roller transport processor. Processing consisted of 3M XAD/2 Developer for 27 seconds at 35° C., followed by fixing in 3M HAF/2 Fixer for 27 seconds at 30° C., washing with tap water for 22 seconds at 35° C. and drying for 22 seconds at 35° C.

The sensitometric results are tabulated in the following Table 5.

TABLE 5

| | 15 h 50° C. | | | 5 days 50° C. | | |
|---|---|---|---|---|---|---|
| Film | Dmin | Speed1 | Speed2 | Dmin | Speed1 | Speed2 |
| 1C | 0.21 | 2.31 | 1.91 | 0.32 | 2.42 | 1.96 |
| 2C | 0.23 | 2.32 | 1.90 | 0.41 | 2.42 | 1.96 |

(speed1 is the absolute sensitivity for X-ray exposure measured at 0.25 above Dmin and speed2 is the absolute sensitivity for X-ray exposure measured at 1.0 above Dmin).

We claim:

1. A light-sensitive silver halide photographic material comprising a support and silver halide emulsion layer or layers, wherein at least one of said silver halide emulsion layers contains tabular silver halide grains having an average diameter:thickness ratio of at least 3:1 and resorcinol, said silver halide grains having been chemically sensitized by chemical sentizers consisting essentially of sodium thiosulfate and gold thiosulfate.

2. The light-sensitive silver halide photographic material of claim 1, wherein resorcinol is present in an amount of about 1 to about 300 millimoles per mole of silver halide in the silver halide emulsion layer containing said tabular silver halide grains.

3. The light-sensitive silver halide photographic material of claim 1, wherein said tabular silver halide grains have an average diameter:thickness ratio of 5:1 to 30:1.

4. The light-sensitive silver halide photographic material of claim 1, wherein said tabular silver halide grains have an average diameter ranging from about 0.3 to 5 micrometers.

5. The light-sensitive silver halide photographic material of claim 1, wherein said tabular silver halide grains have an average thickness of 0.4 micrometers or less.

6. The light-sensitive silver halide photographic material of claim 1, wherein not less than 40% of the silver halide grains are tabular silver halide grains having an average diameter:thickness ratio of at least 3:1.

7. A light-sensitive silver halide material for use in radiography with intensifying screens comprising a transparent support having coated on both sides silver halide emulsion layers, wherein at least one of said silver halide emulsion layers contains tabular silver halide grains having an average diameter:thickness ratio of at least 3:1 and resorcinol, said silver halide grains having been chemically sensitized by chemical sentizers consisting essentially of sodium thiosulfate and gold thiosulfate.

8. A light-sensitive silver halide photographic material comprising a support and silver halide emulsion layer or layers free of a latent image, wherein at least one of said silver halide emulsion layers contains tabular silver halide grains having an average diameter:thickness ratio of at least 3:1 and a fog suppressing amount of resorcinol, said silver halide grains having been chemically sensitized by chemical sentizers consisting essentially of sodium thiosulfate and gold thiosulfate.

* * * * *

UNITED STATES PATENT AND TRADEMARK OFFICE

CERTIFICATE OF CORRECTION

PATENT NO. : 5,077,189

DATED : Dec. 31, 1991

INVENTOR(S) : Luigi Cellone, Mario Mariotti

It is certified that error appears in the above-identified patent and that said Letters Patent is hereby corrected as shown below:

Col. 2, Line 20 "H2O2" should read -- $H_2O_2$ --

Col. 6, Line 26 "t" should read -- to --

Col. 8, Line 15 "2,78" should read -- 2.78 --

Col. 8, Line 38 "L-supercoat" should read -- supercoat --

Signed and Sealed this

Fourteenth Day of September, 1993

*Attest:*

*Attesting Officer*

BRUCE LEHMAN

*Commissioner of Patents and Trademarks*